US008439689B2

(12) United States Patent
Niitsu et al.

(10) Patent No.: US 8,439,689 B2
(45) Date of Patent: May 14, 2013

(54) SHEET CONNECTOR HAVING A TERMINAL PROTRUDING FROM A CONDUCTIVE PATTERN ON A SUBSTRATE TO ENGAGE A TERMINAL OF ANOTHER CONNECTOR

(75) Inventors: Toshihiro Niitsu, Yamato (JP); Akira Sagayama, Yamato (JP); Hirokazu Suzuki, Yamato (JP); Osamu Matsuzaka, Yamato (JP); Yoshinobu Sato, Yamato (JP); Kota Sagayama, Yamato (JP); Nobuhide Morioka, Yamato (JP); Yusuke Shibata, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/296,942

(22) Filed: Nov. 15, 2011

(65) Prior Publication Data

US 2013/0052861 A1 Feb. 28, 2013

(30) Foreign Application Priority Data

Nov. 18, 2010 (JP) ..... 2010-258014

(51) Int. Cl.
*H01R 12/00* (2006.01)

(52) U.S. Cl.
USPC ..... 439/65

(58) Field of Classification Search ..... 439/65–67, 439/74, 591, 492, 850
See application file for complete search history.

(56) References Cited

U.S. PATENT DOCUMENTS

| | | | | |
|---|---|---|---|---|
| 4,695,258 | A * | 9/1987 | Hanson et al. | 439/67 |
| 6,077,096 | A * | 6/2000 | Moring et al. | 439/92 |
| 7,819,710 | B2 * | 10/2010 | McIntire et al. | 439/890 |
| 8,007,286 | B1 * | 8/2011 | Holec et al. | 439/65 |
| 8,105,121 | B2 * | 1/2012 | Miyamoto et al. | 439/883 |
| 8,182,207 | B2 * | 5/2012 | Ballard et al. | 415/126 |

FOREIGN PATENT DOCUMENTS

| | | |
|---|---|---|
| JP | 2007-134169 | 5/2007 |
| JP | 2008-270100 | 11/2008 |

* cited by examiner

*Primary Examiner* — Chandrika Prasad
(74) *Attorney, Agent, or Firm* — Timothy M. Morella

(57) ABSTRACT

An FPC plug, which fits with another connector, comprises a substrate part, a conductive pattern on the surface of the substrate part, a cable part and a connecting part connected to an end of the cable part. The connecting part includes a protruding terminal engaging a terminal of the other connector. The terminal is formed integrally with, and protrudes from a surface of, the conductive pattern; and includes a base end part connected to the surface of the conductive pattern, an upper end part having a width at most equal to the width of the base end part, and a side surface part between the upper end and base end parts. The side surface part recedes toward the inner side in the width direction more than the base end and upper end parts, and includes a minimal point at which the width is at a minimum.

9 Claims, 17 Drawing Sheets

FIG. 4A
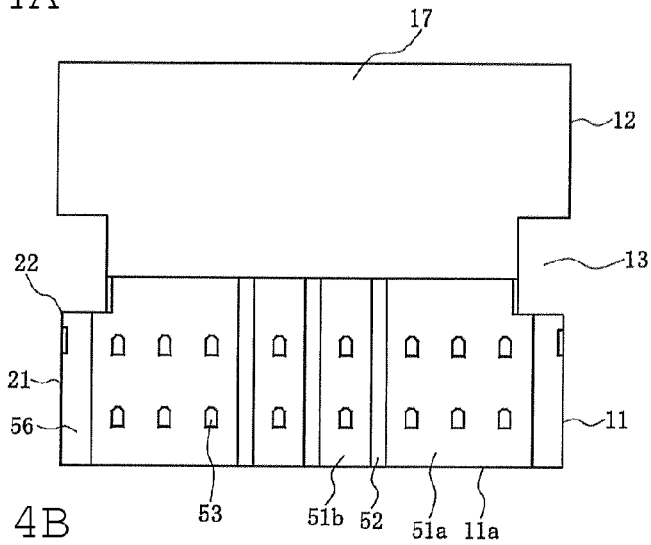
FIG. 4B
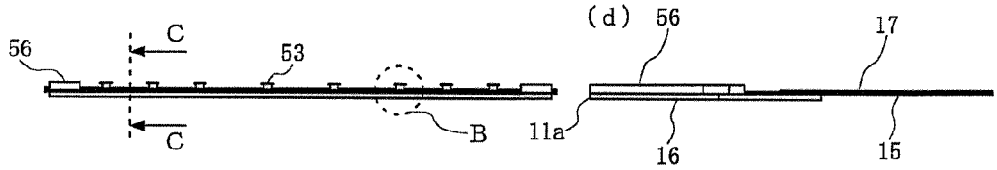
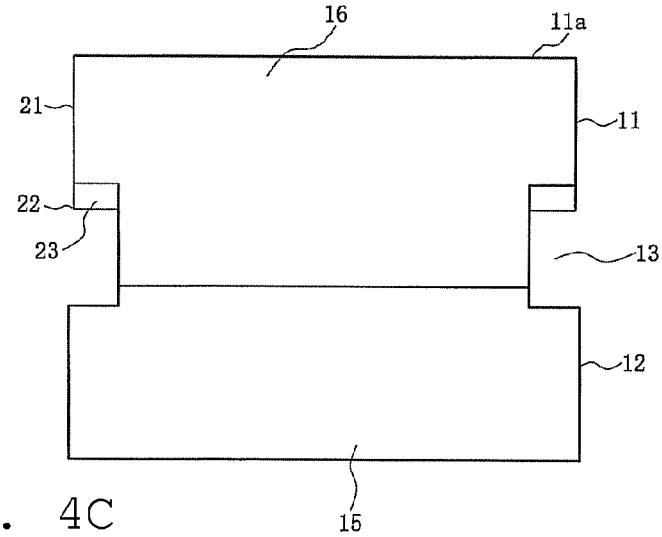
FIG. 4C

FIG. 9A
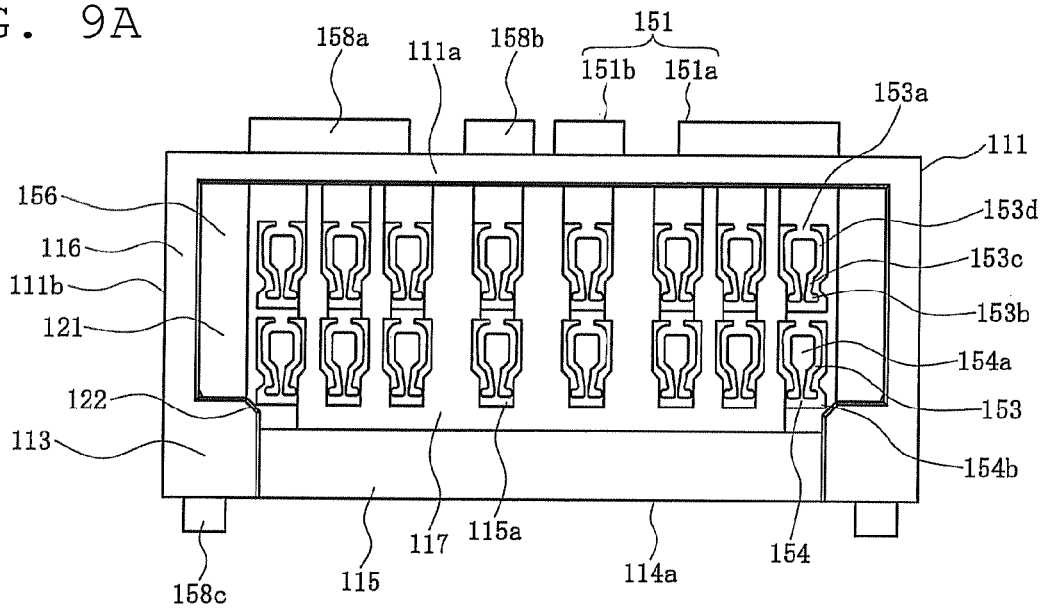
FIG. 9B
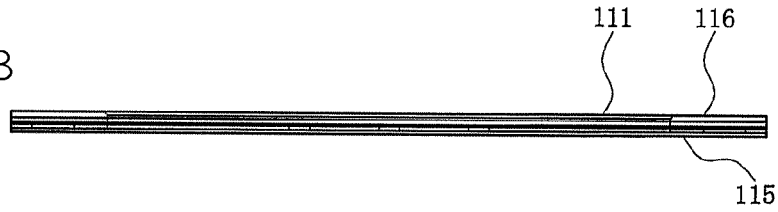
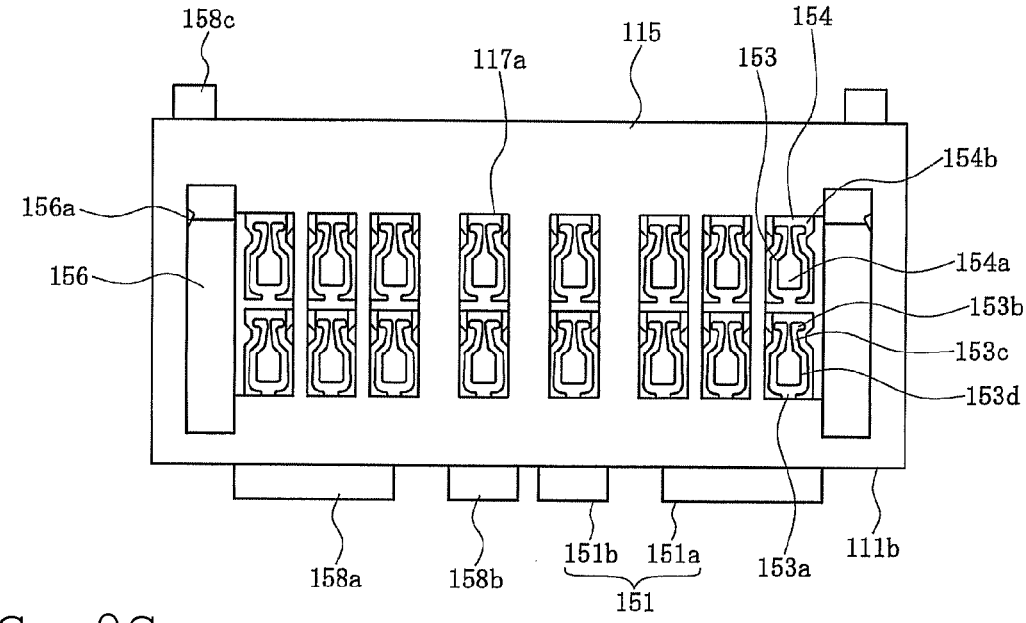
FIG. 9C

FIG. 15A
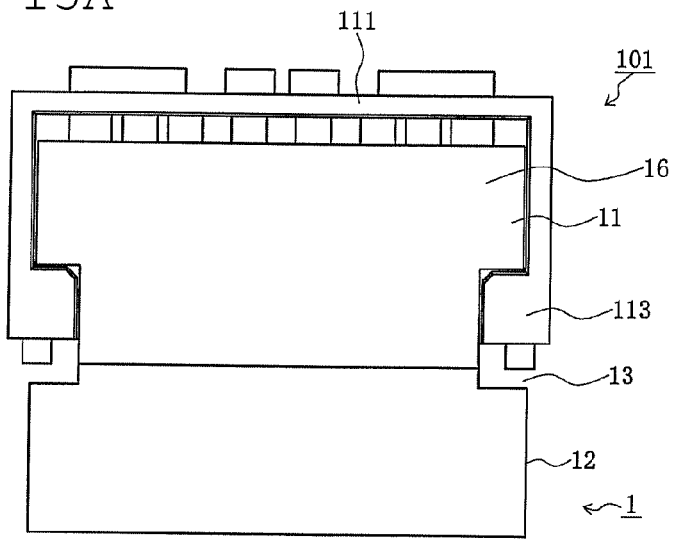
FIG. 15B
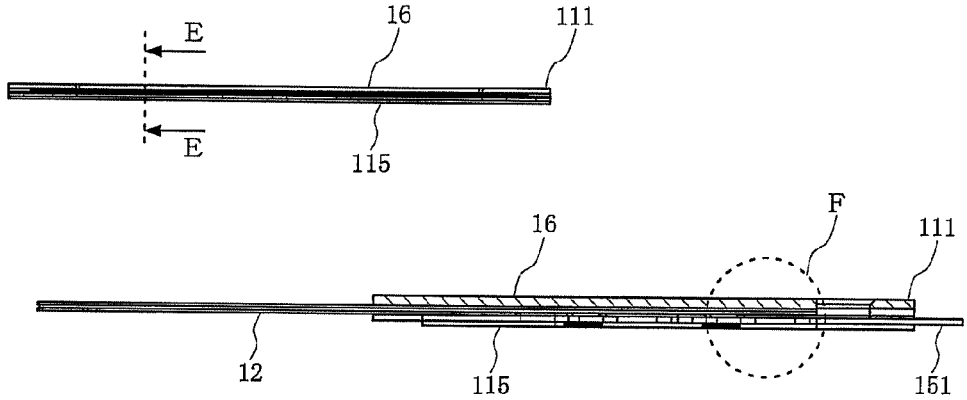
FIG. 15C

SHEET CONNECTOR HAVING A TERMINAL PROTRUDING FROM A CONDUCTIVE PATTERN ON A SUBSTRATE TO ENGAGE A TERMINAL OF ANOTHER CONNECTOR

REFERENCE TO RELATED APPLICATIONS

The Present Disclosure claims priority to prior-filed Japanese Patent Application No. 2010-258014, entitled "FPC Plug," filed on 18 Nov. 2010 with the Japanese Patent Office. The content of the aforementioned Patent Application is fully incorporated in its entirety herein.

BACKGROUND OF THE PRESENT DISCLOSURE

The Present Disclosure relates, generally, to a sheet connector, and, more particularly, to a sheet connector with high reliability while also having a small size, a simple configuration at a low cost and is easy to manufacture, that can stably maintain contact between terminals and can also securely prevent the occurrence of an instantaneous interruption.

Typically, miniaturization and densification are required for conventional connectors to accommodate the miniaturization and high-performance of electronic devices and components. Accordingly, sheet connectors have been proposed that form a plurality of conductive patterns on an insulating film substrate and connect these conductive patterns to other substrates or the like. Examples of such conventional connectors may be found in Japanese Patent Application Nos. 2007-134169 and 2008-270100.

FIG. 18 is a perspective view of a conventional sheet connector. A male side base body 811, as a base body for a male connector, is mounted on the surface of the first circuit board 891. Bumps 851 made of a conductive metal are arranged in a line with a prescribed spacing on the surface of the male side base body 811. Further, a columnar shaped positioning boss 821 is arranged at each end of line of bumps 851. Note that each of the bumps 851 are electrically connected to individual conductive traces 892 of an electric circuit formed on the surface of the first circuit board 891.

Further, a female side base body 911, as a base body for a female connector, is mounted on the surface of the second circuit board 991. Bump receiving holes 922 that pass through from top to bottom of the female side base body 911 are arranged in a line with a prescribed spacing on the female side base body 911. Further, a guide hole 921 is arranged at each end of the line of bump receiving holes 922. Note, a female side electrode pattern 951 made of a conductive metal is formed around the periphery of the bump receiving holes 922 on the second circuit board 991. Each of the female side electrode patterns 951 are electrically connected to individual conductive traces 992 of an electric circuit formed on the surface of the second circuit board 991.

The male connector and the female connector are connected by aligning the surface of the male side base body 811 to face the surface of the female side base body 911 and inserting the bumps 851 and the positioning bosses 821 into the corresponding bump receiving holes 922 and guide holes 921. When doing so, the peripheral edge of each bump 851 contacts the female side electrode pattern 951 of the corresponding bump receiving hole 922 to complete conductivity. In this manner, each of the conductive traces 892 on the first circuit board 891 conduct with the corresponding conductive traces 992 of the second circuit board 991.

However, with the conventional sheet connector, the connected state between the male connector and the female connector is unstable creating a state in which conductivity can be momentarily cut, which is to say, it may generate an instantaneous interruption. This is because, the height dimension of the bumps 851 of the male connector and the thickness dimension of the female side electrode pattern 951 of the female connector gets smaller as the male and female connectors get thinner making the contact area smaller between the bumps 851 and the female side electrode pattern 951 smaller, and therefore, any slight external force, vibration, or the like will have an effect on the state of contact between the bumps 851 and the female side electrode pattern 951.

SUMMARY OF THE PRESENT DISCLOSURE

An object of the Present Disclosure, in order to solve the problem of the conventional sheet connector, is to provide a sheet connector with high reliability while also having a small size, a simple configuration at a low cost and is easy to manufacture, that can stably maintain contact between a protruding terminal and another terminal and can securely prevent the occurrence of an instantaneous interruption by making the side surface of the protruding terminal that engages with the other terminal to be a concave surface. Therefore, the sheet connector of the Present Disclosure includes a sheet connector provided with a flat plate shaped substrate part and a plate-like conductive pattern arranged on the surface of the substrate part while including a flat plate shaped cable part and a flat plate shaped connecting part connected to the tip end of the cable part, and which fits with another connector; wherein, the connecting part includes a protruding terminal that engages with another terminal of the other connector; the protruding terminal is a member integrally formed with the conductive pattern so as to protrude from the surface of the conductive pattern and includes a base end part connected to the surface of the conductive pattern, and upper end part provided with a width dimension that is equal to or below the width dimension of the base end part, and a side surface part between the upper end part and the base end part; and the side surface part is provided with a shape that recedes toward the inner side in the width direction more than the base end part and the upper end part and includes a minimal point at which the width dimension is at a minimum.

Another sheet connector is further configured in that the width dimension of the protruding terminal is largest at the base end part and gradually decreases going upward and is smallest at the minimal point, then gradually increases going further upward to be equal to or less than the size of the base end part at the top end part. Still another sheet connector is further configured in that the side surface part is elastically sandwiched from both sides by a pair of connecting parts of the other terminal when the protruding terminal engages with the other terminal. Still another sheet connector is further configured in that the dimension in the vertical direction of the side surface part is larger than the dimension in the vertical direction of the connecting part of the other terminal. Still another sheet connector is further configured in that a horizontal cross-section of the protruding terminal has a dimension in which the front and rear direction is larger than the dimension of the width direction, and the rear direction has a pointed shape. Still another sheet connector is further configured in that the protruding terminal is provided in a plurality and is arrayed in a lattice shape on the surface of the conductive pattern on the connecting part. Still another sheet connector is further configured in that a solder barrier is formed at least partially around the periphery of the protruding terminal on the surface of the connecting part. Still another sheet connector is further configured in that the solder barrier is formed in a strip shape so as to extend in the width direction of the connecting part. Still another sheet connector is further configured in that the solder barrier is made of a hydrophobic coating.

According to the Present Disclosure, the sheet connector is configured such that the side surface of the protruding terminal that engages with the other terminal forms a concave surface. By so doing, contact between the protruding terminal and the other terminal can be stably maintained and the occurrence of an instantaneous interruption can be securely prevented. Further, reliability can increased while also having a small size, a simple configuration at a low cost that is easy to manufacture.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIG. 4 is four views of the male connector of FIG. 1, where (a) is a top surface view, (b) is a front surface view, (c) is a bottom surface view, and (d) is a side surface view;

FIG. 9 is three views of the female connector of FIG. 8, where (a) is a top surface view, (b) is a front surface view, and (c) is a bottom surface view;

FIG. 15 is three views illustrating a state in which the fitting process of FIG. 13 is complete, where (a) is a top surface view, (b) is a front surface view, and (c) is a side cross-sectional view which is a cross-sectional view of the portion indicated by the arrows E-E in (b);

DESCRIPTION OF THE PREFERRED EMBODIMENTS

Figure 1:
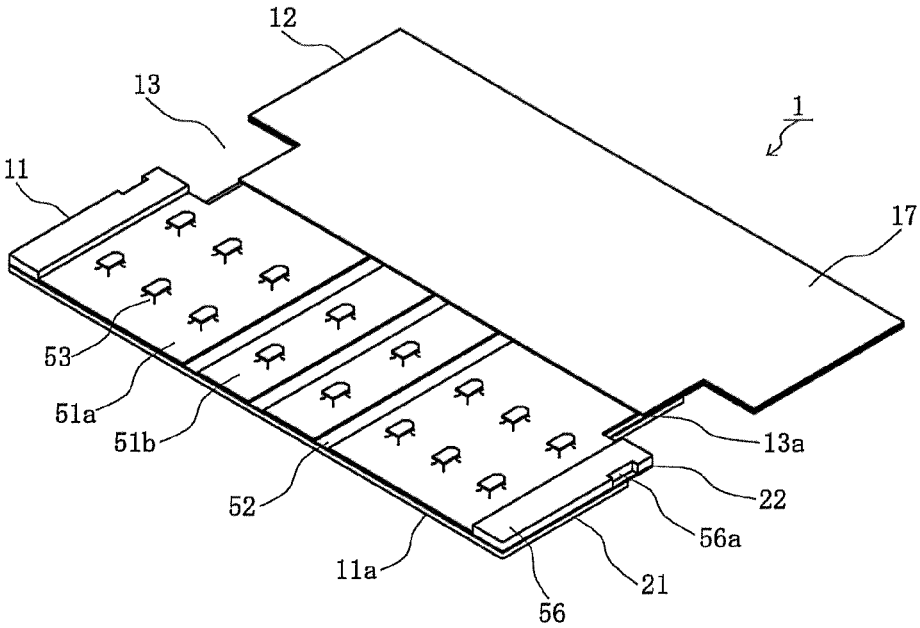
FIG. 1 is a perspective view as seen from the top surface side of the male connector according to an embodiment of the Present Disclosure.

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Referring to FIGS. 1-7, a male connector 1, representing a first connector and one side of the sheet connector, is electrically connected to a female connector 101, representing a second connector and the other side of the sheet connector (to be described later). The male connector 1 includes a flat plate shaped cable part 12 and a flat plate shaped connecting part 11 that has been integrally formed on the tip end of the cable part 12. An intermediate recessed part 13 is formed as a recessed part on both the left and right sides in the boundary area between the cable part 12 and the connecting part 11 for engaging with the female connector 101.

The cable part 12 is a flexible cable with a flat plate shape known as a Flexible Printed Circuit (FPC) and a Flexible Flat Cable (FFC), and can be a circuit board, a cable or the like, as long as it is flat. Also, the cable part 12 includes a base film 15, as a male base plate part, a plate like first board part that is a thin plate insulating member provided in a long and thin strip shape, and a conductive pattern 51, as a male conductor, a first conductor that functions as a plurality of conductive lines arranged in parallel on one side (upper side in FIG. 7) of the base film 15. In addition, a cover film 17 is arranged on the other side (upper side in FIG. 7) of the conductive pattern 51 as a male covering part which is a plate like first covering part that is a thin plate insulating member provided in a long and thin strip shape. In other words, the cable part 12 is a flat plate shaped member provided with a layer structure, laminated, in order from the bottom, of the base film 15, the conductive pattern 51 and the cover film 17. Further, the conductive pattern 51 is formed by patterning on a copper foil attached to one side of the base film 15 in advance.

The Figures illustrate a case in which the male connector 1 is used to connect to the power source, the conductive pattern 51 is made of a pair of wide patterns 51*a* and a pair of narrow patterns 51*b* arranged mutually parallel, and each of the adjacent conductive patterns 51 are separated by a pattern separation spaced 52. For example, a wide pattern 51*a* may be used as a ground line while the narrow pattern 51*b* may be used as the power line. However, the number, pitch, and type of arrangement of conductive patterns 51 can be appropriately modified as necessary. For example, as long as the male connector 1 is used for connecting the signal line, each of the conductive patterns 51 can be formed in narrower width line like shapes with a prescribed pitch, and the number of which can be arranged to be mutually parallel.

Further, the cable part 12 may be a long strip like member, but in the Figures, for purposes of illustration, the rearward portion (top right direction—FIG. 1) is illustrated as cutaway. Note that another flat plate shaped cable can be connected rearward of the cable part 12.

Further, the connecting part 11 may also include a base film 15 and a conductive pattern 51 arranged on one side of the base film 15. The conductive patterns 51 may be configured so as to continue from the cable part 12 and terminate within the connecting part 11. In the Figures, the conductive patterns 51 extend to the tip end part 11*a* of the connecting part 11 and terminate at the tip end part 11*a*; but, they can be configured to terminate midway within the connecting part 11. Further, a reinforcing layer 16 is arranged on the other surface (the lower surface in FIG. 7) of the base film 15 as a reinforcing plate-like part which is a flat thin plate member. In other words, the connecting part 11 is a flat plate shaped member provided with a layer structure, laminated, in order from the bottom, the reinforcing layer 16, the base film 15 and the conductive pattern 51.

Further, ear parts 21 are respectively provided on the left and right sides of the connecting part 11 that extend outward in relative width directions more than the intermediate recessed part 13. The ear part 21 functions as a protruding part for engaging the female connector 101, and the rear end part thereof is a male fitting lock part 22 that functions as a fitting lock. Further, the male fitting lock part 22 engages the female fitting lock part 122 of the female connector 101, and locks so as to maintain a fitted state between the male connector 1 and female connector 101. Note that, in the illustrated example, the width dimension of the connecting part 11 is equivalent to that of the cable part 12, but it is not required to be equivalent to the width dimension of the cable part 12 and may be larger or smaller than the width dimension of the cable part 12.

Additionally, the ear parts 21 are thick strips that extend in the front and rear direction of the male connector 1, and are provided with an insertion raised part 56 that protrudes upward from the top surface of the connecting part 11. The side edge of the insertion raised part 56 is formed so as to match with the side edge 21*a* of the ear part 21, and a locking recessed part 56*a* formed on the portion at the farthest rear end—the closest area of the male fitting lock part 22, so to recede toward the inner side in the width direction. The locking recessed part 56*a* is locked to the locking raised part 156*a* of the female connector 101, and prevents the engagement between the male fitting lock part 22 and the female fitting lock part 122 from releasing. Note that, in the illustrated example, the insertion raised part 56 is integrally formed with the conductive pattern 51 on the top surface of the conductive pattern 51, but the member is not required to be an integrated part with the conductive pattern 51, and can be a member that is configured independently from the conductive member 51.

Figure 2:
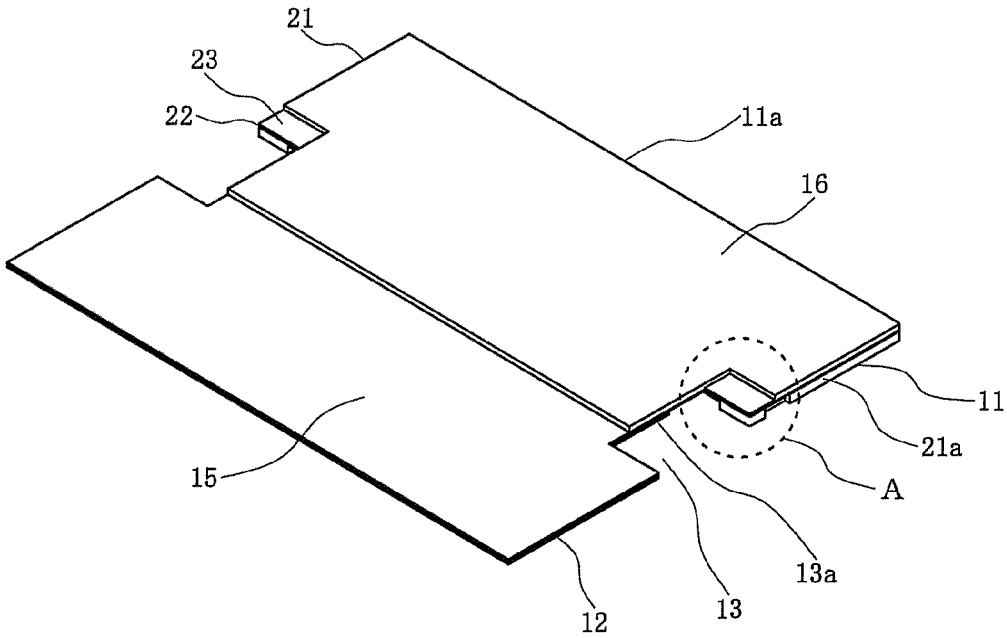
FIG. 2 is a perspective view as seen from the bottom surface side of the male connector of FIG. 1.
Figure 3:
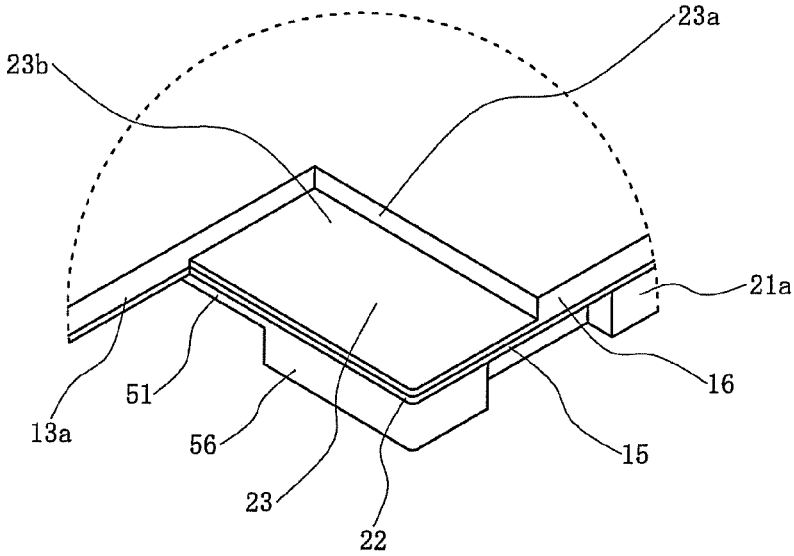
FIG. 3 is a magnified view of the male fitting locking part of the male connector of FIG. 1, and is a magnified view of the A portion in FIG. 2.

The male fitting lock part 22, as illustrated in FIGS. 2-4, is provided with a male side step part 23 as a fitting step part formed on the back surface. The male side step part 23 is formed so as to recede from the back surface of the connecting part 11—more specifically, the back surface of the reinforcing layer 16, and in addition to being substantially orthogonal to the back surface of the connecting part 11, it includes a step part end surface 23*a* that extends in a parallel direction to the width direction of the connecting part 11 and a stepped surface 23*b* that extends in parallel to the back surface of the connecting part 11. As illustrated, the boundary of the width direction inner side of the connecting part 11 on the male side step part 23 is demarcated by the side edge 13*a* of intermediate recessed part number 13.

The top surface of the conductive pattern 51 on the connecting part 11 is exposed, and the protruding terminals 53 are arranged as a plurality of male terminals on the top surface of the conductive pattern 51. The protruding terminal 53 in the illustrated example is arrayed in a lattice shape and is arrayed to form a pair of rows that extend in the width direction. Specifically, three protruding terminals 53 are included in each row with the wide pattern 51*a*, and one protruding terminal 53 is included in each row with the narrow pattern 51*b*. The protruding terminals 53 in the front row and rear row are arranged in a direct line that extends in the front and rear direction of the male connector 1. In other words, it is arranged to form a rectangular planar lattice in which the axes that extend in the front and rear direction and the left and right direction of the male connector 1 form a lattice line.

Each of the protruding terminals 53 protrude upward from the top surface of the conductive patterns 51 and are integrally formed with the conductive patterns 51. The height, that is to say the position of the upper surface, of the protruding terminals 53 in the example illustrated in FIG. 6(*b*) is the same as the position of the upper surface of the insertion raised part 56, but it is not required to be the same as the position of the upper surface of the insertion raised part 56 and can be higher or lower. Further, as for the shape of the horizontal cross section and upper surface of the protruding terminal 53, the dimension of the front and rear direction is larger than the dimension of the width direction as clearly illustrated in FIG. 4(*a*), and is preferably shaped in a hexagon or a pentagon similar to a home plate in baseball having pointed rear side, but it is not required to be limited to the example illustrate in the drawing but can be circular or elliptical, and can be modified to discretion.

Figure 5:
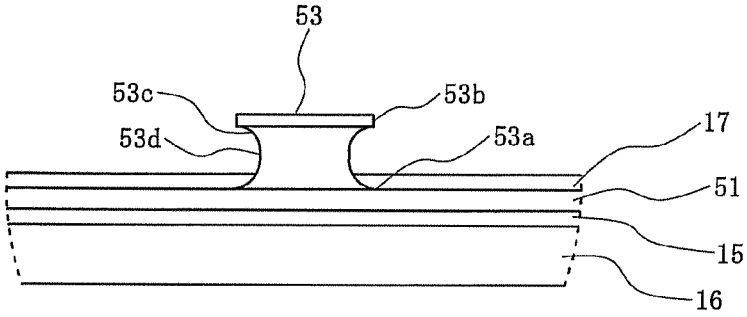
FIG. 5 is a magnified front surface view of the male terminal of the male connector of FIG. 1, and is a magnified view of the B portion in FIG. 4(*b*)

In the present embodiment, the side surface shape of the protruding terminals 53 is a concave surface as illustrated in FIG. 5. Specifically, with the protruding terminals 53, the width dimension of the base end part 53*a*, which is the portion that is connected with the top surface of the conductive pattern 51, is equal to or greater than the width dimension of the tip end part 53*b* which is the upper end part, and the side surface part 53*c* between the base end part 53*a* and the tip end part 53*b* is a smooth surface with a smooth shape such that recedes in toward the width direction thereof more than the base end part 53*a* and the tip end part 53*b* and includes a minimal point 53*d* midway thereof that is where the width dimension is the smallest. In other words, the width dimension of the protruding terminals 53 is largest at the base end part 53*a* and gradually decreases going upward and is smallest at the minimal point 53*d*, then gradually increases going further upward to be equal to or less than the size of the base end part 53*a* at the tip end part 53*b*. The shape of the side surface part 53*c* is preferably a slow continuous curved surface but it may also be a bending curved surface with a successive plurality of slanted planes.

Figure 6B:
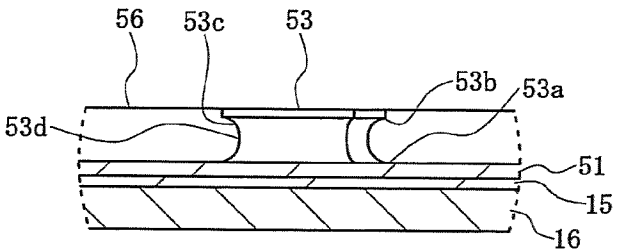
FIG. 6 is a cross-sectional view of the male connector of FIG. 1, where (a) is a cross-sectional view of the portion indicated by the arrows C-C in FIG. 4(*b*), and (b) is a magnified side surface view of the male terminal and is a magnified view of the D portion in (a)
Figure 6A:
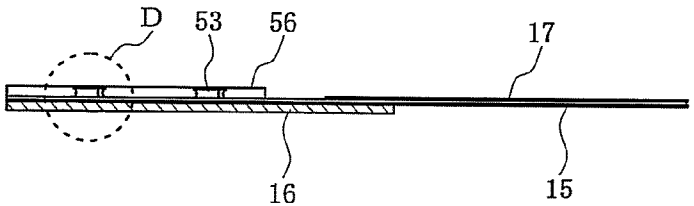
Figure 7:
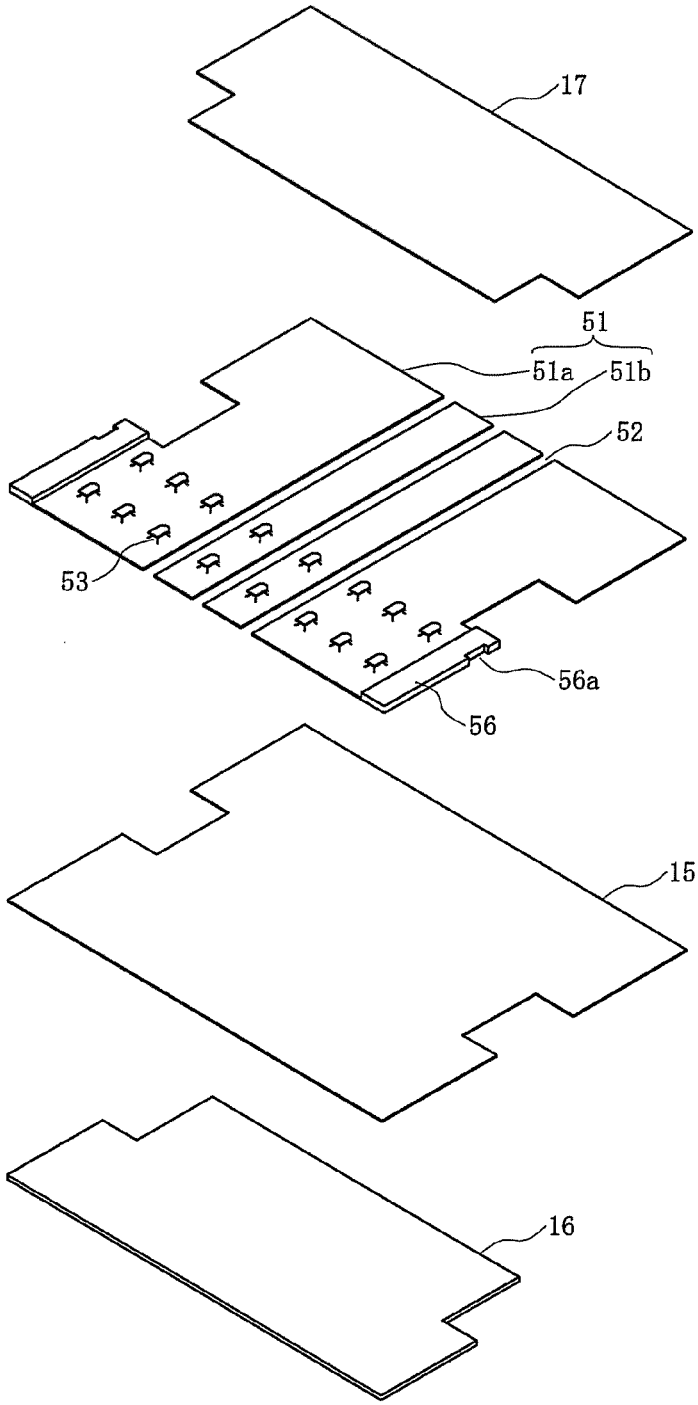
FIG. 7 is an exploded view illustrating the layer structure of the male connector of FIG. 1.

Further, the side surface shape of the protruding terminals 53 when viewed from the side of the male connector 1 also similarly takes a concave surface as illustrated in FIG. 6(*b*). In other words, the width dimension of the base end part 53*a* is equal or greater than the width dimension of the tip end part 53*b*, and the side surface part 53*c* has a shape that recedes in toward the width direction thereof more than the base end part 53*a* and the tip end part 53*b* and includes a minimal point 53*d* midway thereof that is where the width dimension is the smallest. In other words, the width dimension of the protruding terminals 53 is largest at the base end part 53*a* and gradually decreases going upward and is smallest at the minimal point 53*d*, then gradually increases going further upward to be equal or less than the size of the base end part 53*a* at the tip end part 53*b*.

When the protruding terminal 53 engages with the receiving terminal 153 (to be described later) having the female connector 101, the side surface part 53*c* is elastically sandwiched from both sides by a pair of connecting parts 153*c* to be described later of the receiving terminal 153. Further, as will be discussed later, because the receiving terminal 153 is a thick member, and the thickness dimension (the vertical direction) of the connecting part 153*c* is smaller than the height dimension (the vertical direction) of the receiving terminal 153, the connecting part 153*c*, when receiving an external force or when receiving a vibration, may have the ability to move in the vertical direction of the protruding terminal 53 along the side surface part 53*c*. However, because the side surface part 53*c* is a smooth concave surface and includes a minimal point 53*d*, the position of the connecting part 153*c* that is elastically pressed to the side surface part 53*c* is always converged with the minimal point 53*d*, and because the elastic pressing force is greater when separating from the minimal point 53*d*, the connecting part 153*c* does not separate from the side surface part 53*c*. In other words, because the side surface part 53*c* is a concave surface, and because contact between the side surface part 53*c* and the connecting part 153*c* is securely maintained when receiving an external force or when receiving a vibration, an instantaneous interruption does not occur between the protruding terminal 53 and the receiving terminal 153.

Referring to FIGS. 8-12, the female connector 101 is a second connector that functions as the other side of the sheet connector and is provided in a rectangular planar shape and is mounted on the surface of a board such as a printed circuit board of a flexible circuit board (not shown) while being electrically connected to the male connector 1. In this case, the female connector 101 has a plate like shape and is mounted so that the back surface thereof faces the top surface of the board, and is electrically connected to the conductive trace of the board.

Further, the female connector 101 includes a flat plate shaped frame 111 in which the top surface shape is substantially in the shape of a C. The frame 111 is provided with a horizontal frame part 111*a* that extends in the width direction (direction connecting the bottom left with the top right in FIG. 8) of the female connector 101 and a vertical frame part 111*b* that extends toward the front (bottom left side in FIG. 8) from both ends of the horizontal frame part 111*a*. A wide part 113 is formed on the front end of the vertical frame part 111*b* that engages with the intermediate recessed part 13 of the male connector 1.

Further, the flat recessed part, provided in a rectangular planar shape demarcated by the periphery according to the frame 111, is a connecting recessed part 114 where the connecting part 11 of the male connector 1 is received. The bottom part 114*a* of the connecting recessed part 114 is a flat plate shaped member provided with a layer structure laminated in the order from the bottom of the base film 115, the conductive pattern 151, and the cover film 117. The frame 111 is a thick flat plate shape compared to the connecting recessed part 114.

The example illustrated in the Figures indicates a case in which the female connector 101 is used to connect to the power source, and the conductive pattern 151 is made of a pair of wide patterns 151*a* and a pair of narrow patterns 151*b* arranged mutually parallel, and each of the adjacent conductive patterns 151 are separated by a pattern separation spaced 152. The conductive pattern 151 is a female conductor as a second conductor that functions as a plurality of conductive lines. For example, the wide pattern 151*a* is used as a ground line while the narrow pattern 151*b* is used as the power line. The number, pitch and type of arrangement of conductive patterns 151 can be appropriately modified as necessary.

In the Figures, a wide rear tail part 158*a* and a narrow rear tail part 158*b* are integrally formed with the wide pattern 151*a* and the narrow pattern 151*b* so as to protrude rearward from the horizontal frame part 111*a* of the frame 111 and are connected by soldering to a connection pad or the like, formed on the surface of the board (not shown). Additionally, 158*c* is a front tail part integrally formed with the wide pattern 151*a* so as to protrude forward from the wide part 113 of the frame 111 and is connected by soldering to a connection pad or the like, formed on the surface of the board (not shown). Note that the phrase "tail part 158" collectively describes the wide rear tail part 158*a*, the narrow rear tail part 158*b* and the forward tail part 158*c*. When the tail part 158 is connected to the connection pad, the female connector 101 is fixed to the board and the conductive patterns 151 conduct with the corresponding conductive traces on the board.

Receiving terminals 151 are arranged as a plurality of female terminals on portion that corresponds to the bottom part 114*a* of the connecting recessed part 114 for the conductive patterns 151. The receiving terminals 153 are members that conduct by fitting with the protruding terminals 53 of the male connector 1, and therefore the array thereof is similar to the array of the protruding terminals 53. Further, when modifying the configuration for the array of protruding terminals 53, the configuration for the array of receiving terminals 153 are also modified in order to appropriately match thereto. In addition, because the conductive pattern 151 is also a member for conducting with the conductive patterns 51 of the male connector 1, the array thereof is similar to the array of the conductive patterns 51 of the male connector 1, and when modifying the configuration for the array of conductive patterns 51, the configuration for the array of conductive patterns 151 are also modified in order to appropriately match thereto.

Each of the receiving terminals 153 are members in which the conductive patterns 51 are received into a substantially rectangular terminal receiving opening 154 that penetrates through in the thickness direction and are formed by patterning the conductive patterns 151. Typically, the pattern that remains formed after patterning the conductive pattern 151 is the receiving terminal 153, and the portion where the material around the receiving terminal 153 was removed becomes the terminal receiving opening 154. Accordingly, the thickness dimension of the receiving terminal 153 is equivalent to the thickness dimension of the conductive pattern 151.

Further, the planar shape of each receiving terminal 153 has left and right symmetry. Additionally, each receiving terminal 153 is provided with a base part 153*a* connected to the peripheral edge of the terminal receiving opening 154, a pair of arm parts 153*d* connected to the base part 153*a*, a pair of contact parts 153*c* connected to the tip end of each arm part 153*d*, and a pair of free end parts 153 connected to the tip end of each contact part 153*c*. The left and right arm parts 153*d*, the contact parts 153*c* and the free end parts 153*b* are parts that have mutually facing left and right symmetry. The arm parts 153*d* are shaped as a cantilever that functions as a spring, and the free end parts 153*b* and the contact parts 153*c* are elastically displaced in the width direction of the female connector 101 due to the bias of the arm parts 153*d*.

Also, the terminal receiving opening 154 includes an inside opening 154*a* on the inside of the receiving terminal 153 and an outside opening 154*b* on the outside of the receiving terminal 153. The inside opening 154*a* is the portion received by the penetration of the protruding terminal 53 when the receiving terminal 153 engages with the protruding terminal 53 of the male connector 1, and the outside opening 154*b* is the portion that allows the displacement of the arm part 153*d*, the free end part 153*b*, and the contact part 153*c*.

With the inside opening 154*a*, the portion between the mutually facing arm parts 153*d* is provided with a large area, and typically, the width dimension thereof is larger than the width dimension of the tip end part 53*b* of the protruding terminal 53, and the dimension of the vertical direction thereof is larger than the dimension in the vertical direction of the tip end part 53*b* of the protruding terminal 53. Therefore, the protruding terminal 53 can smoothly penetrate into the inside opening 154*a*. Meanwhile, the portion between the mutually facing contact parts 153*c* is an air space with a narrow width, and typically, the width dimension thereof is smaller than the width dimension at the minimal point 53*d* of the protruding terminal 53. Therefore, because the gap between the mutual contact parts 153*c* contact the side surface part 53*c* of the protruding terminal 53 and are spread apart due to the relative movement between the mutual contact parts 153*c* by the protruding terminal 53 that is received into the inside opening 154*a*, a state is created in which the contact part 153*c* is pressed against the side surface part 53*c* of the protruding terminal 53 due to the bias of the arm part 153*d*. In other words, a pair of contact parts 153*c* elastically sandwiches the side surface part 53*c* of the protruding terminal 53 from both sides.

When the shape of the inside opening 154*a* approaches the portion between the mutual contact parts 153*c*, the shape is such that the width dimension gradually decreases. In other words, the portion near the contact part 153*c* for the side end edge of the corresponding arm part 153*d* is provided with a slanted tapered shape. Therefore, the protruding terminal 53 can smoothly penetrate the portion between the mutually facing contact parts 153*c*.

An insertion recessed part 156, a substantially rectangular opening that receives the insertion raised part 56 of the male connector 1, is formed in the portion near both ends in the width direction of the conductive pattern 151. Each of the insertion recessed parts 156 are openings that, similar to the terminal receiving openings 154, penetrates through the conductive patterns 51 in the thickness direction and are formed by patterning the conductive patterns 151. A locking raised part 156*a* is formed on the outside edge of the portion near the front end of the insertion recessed part 156. The locking raised part 156*a* is a raised part formed on the tip end of a cantilever shaped member that functions as a spring and elastically displaces in the width direction of the female connector 101 due to the bias of the cantilever shaped member. Further, the locking raised part 156*a* locks with the locking recessed part 56*a* formed on the side edge of the insertion raised part 56 of the male connector 1 and prevents the engagement between the male fitting lock part 22 and the female fitting lock part 122 from releasing.

The base film 115 is a female base plate part as a second base plate part that is a thin plate insulating member. Further, terminal accommodating openings 115*a* and recessed part accommodating openings 115*b* that penetrate through the base film 115 in the thickness direction are respectively formed on the base film 115 in the areas that correspond to the receiving terminals 153 and the insertion recessed parts 156 formed on the conductive patterns 151. The receiving terminals 153 are formed in a pair of rows that extend in the width direction and are arrayed so that a front row and a rear row of receiving terminals 153 are positioned in direct lines that extend in the front and rear direction of the female connector 101, and therefore, each of the terminal accommodating openings 115*a* are provided in a long rectangular shape in the front and rear direction so as to accommodate the front row and rear row pair of receiving terminals 153.

Further, the cover film 117 is a female cover part as a second covered plate part that is a thin plate member with insulating properties. Further, terminal accommodating openings 117*a* and recessed part accommodating openings 117*b* that penetrate through the cover film 117 in the thickness direction are respectively formed on the cover film 117 in the areas that correspond to the receiving terminals 153 and the insertion recessed parts 156 formed on the conductive patterns 151. Each of the terminal accommodating openings 117*a* are provided in a long rectangular shape in the front and rear direction so as to accommodate the front row and rear row pair of receiving terminals 153.

Further, the bottom part 114*a* of the connecting recessed part 114 formed by laminating the base film 115, the conductive pattern 151 and the cover film 117 is provided with an ear receiving recessed part 121 provided at both ends in the width direction. The ear receiving recessed part 121 is the opening that passes through the bottom part 114*a* in the thickness direction that accommodates the recessed part accommodating opening 115*b* of the base film 115, the insertion recessed part 156 of the conductive pattern 151, and the recessed accommodating opening 117*b* of the cover film 117. In addition, the terminal receiving opening 154 is the opening that passes through the bottom part 114*a* in the thickness direction that accommodates the terminal accommodating opening 115*a* of the base film 115, and the terminal accommodating opening 117*a* of the cover film 117. In the illustrated example, the conductive pattern 151 and the cover film 117 are not provided in the corresponding area between the left and right wide parts 113 but includes only the base film 115.

Figure 10:
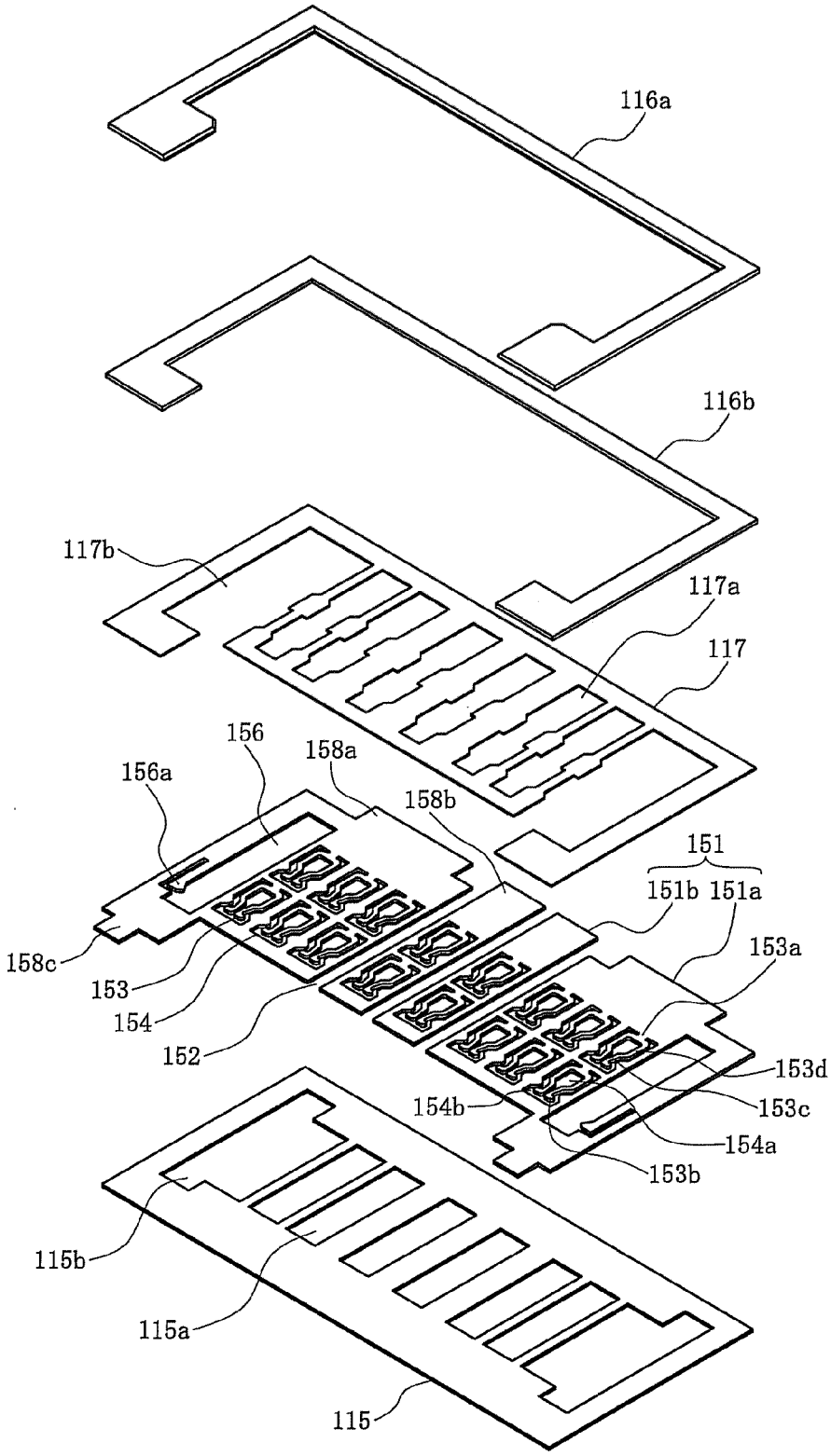
FIG. 10 is an exploded view illustrating the layer structure of the female connector of FIG. 8.
Figure 11:
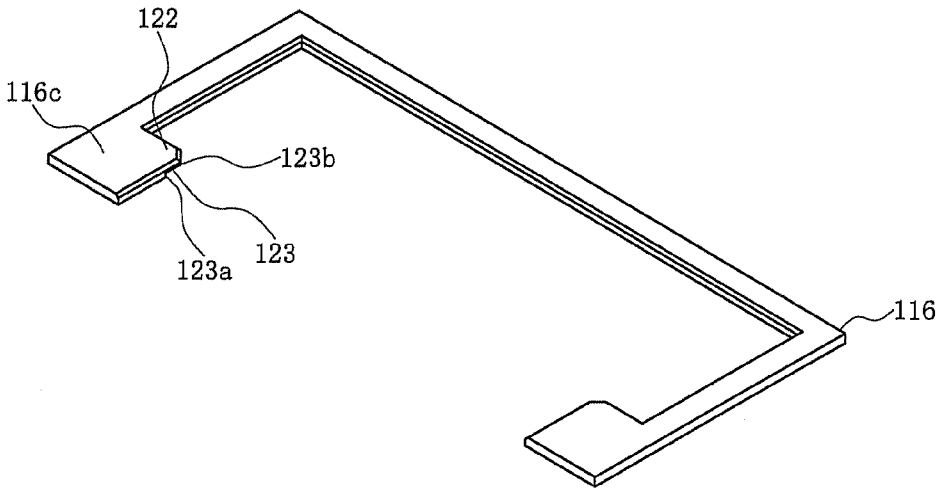
FIG. 11 is a perspective view of the reinforcing layer of the female connector of FIG. 8.

In addition, a frame reinforcing layer 116 is laminated on top of the cover film 117. The frame reinforcing layer 116 is a thin plate member provided with a top surface shape substantially in the shape of a C. Also, the frame reinforcing layer 116, as illustrated in FIG. 10, can be a material configured by laminating a first frame reinforcing layer 116*a* with a second frame reinforcing material 116*b*, or it can be a single material integrally configured as illustrated in FIG. 11. Note, though, as illustrated in FIG. 10, when configuring by laminating the first frame reinforcing layer 116*a* with a second frame reinforcing material 116*b*, different materials can be used in combination such that the material for the first frame reinforcing layer 116*a* is a metal and the material for the second frame reinforcing layer 116*b* is a resin.

The frame reinforcing layer 116 is a member that configures the uppermost layer of the frame 111, and the top surface shape thereof matches with the top surface shape of the frame 111. Further, as illustrated in FIG. 11, the frame reinforcing layer 116 has a wide part 116*c* that corresponds to the wide part 113 of the frame 111, and the rear end part of the wide part 116*c* functions as a female fitting lock part 122 as the fitting lock part. Because the wide part 113 is positioned to the rear end of ear receiving recessed part 121, the female fitting lock part 122 is the rear end part of the ear receiving recessed part 121 and engages with the male fitting lock part 22 of the male connector 1 and locks so as to maintain a fitted state between the male connector 1 and female connector 101.

The female fitting lock part 122 is provided with a female side step part 123 as a fitting step part formed on the back surface. The female side step part 123 is formed so as to recede from the back surface of the frame reinforcing layer 116, and in addition to being substantially orthogonal to the back surface of the frame reinforcing layer 116 and the top surface of the female connector 101, it includes a step part end surface 123*a* that extends in a parallel direction to the width direction of the female connector 101 and a stepped surface 123*b* that extends in parallel to the back surface of the frame reinforcing layer 116 and to the top surface of the female connector 101. The step part end surface 123*a* accommodates the recessed part accommodating opening 115*b* of the base film 115, the insertion recessed part 156 of the conductive pattern 151, and the front end edge of the recessed accommodating opening 117*b* of the cover film 117.

Figure 8:
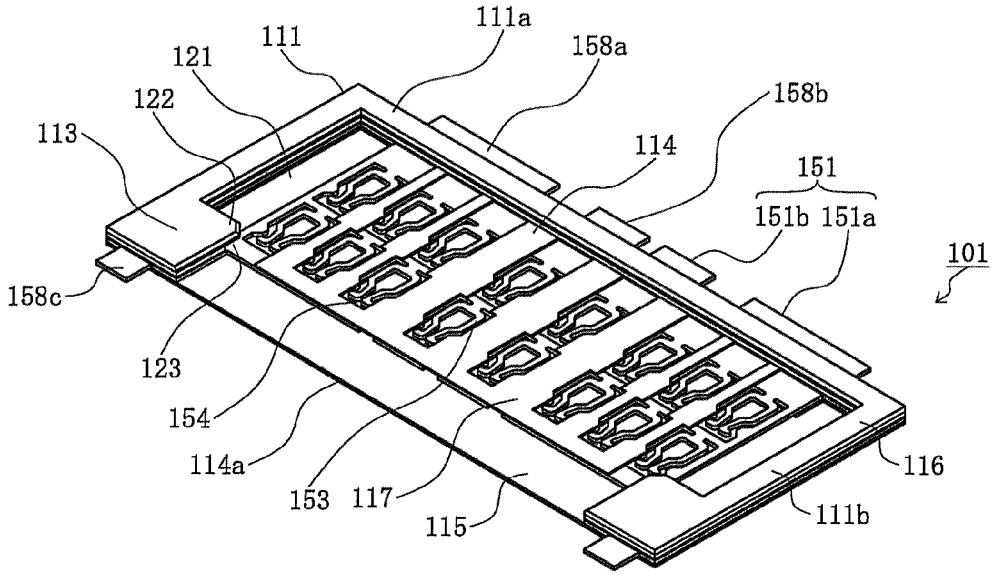
FIG. 8 is a perspective view as seen from the top surface side of the female connector according to an embodiment of the Present Disclosure.
Figures 12A, 12B, 12C, 12D:
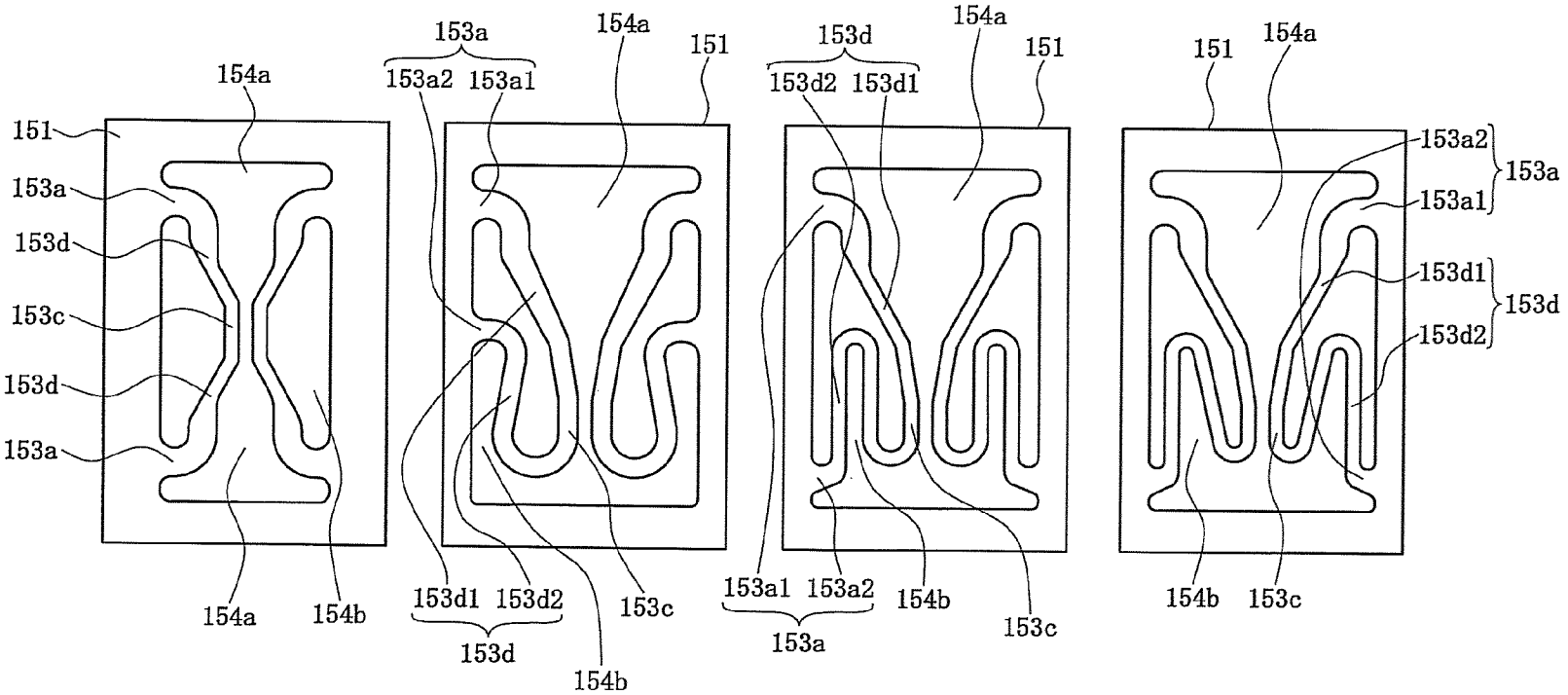
FIG. 12 is a top surface view illustrating a modified form of the female terminal of the female connector of FIG. 8, and (a) to (d) are modified examples 1 to 4.

It should be noted that the planar shape of the receiving terminal 153 need not be limited to the example illustrated in FIGS. 8-10, but may also be a shape as illustrated in FIGS. 12(*a*)-(*d*). As a note, the top sides and bottom sides in FIGS. 12(*a*)-(*d*) correspond to the front side and rear side of the female connector 101.

In the example illustrated in FIG. 12(*a*), the planar shape of the receiving terminal 153 is laterally symmetrical as well as vertically symmetrical. The receiving terminal 153 includes base parts 153*a* connected each in a pair to each of the left and right side edges of the terminal receiving openings 154 and separates the left side portion and the right side portion provided in a laterally symmetrical planar shape. Further, each of the left side portions and right side portions provide arm parts 153*d* that are connected to each base part 153*a* above and below and contact parts 153*c* that connect the tip end of the armed part 153*d* above and below, and is provided with a vertically symmetrical planar shape.

In addition, the terminal receiving opening 154 includes an upper and lower pair of inner openings 154*a* positioned between the left and right arm parts 153*d*, and a left and right pair of outer openings 154*b* positioned outside of the contact parts 153*c*. Further, the gap between the left and right mutually facing contact parts 153*c* is narrower than the gap between the mutual arm parts 153*d*. When the shape of the inside opening 154*a* approaches the portion between the mutual contact parts 153*c*, the shape is such that the width dimension gradually decreases. In other words, the portion near the contact part 153*c* for the side end edge of the corresponding arm part 153*d* is provided with a slanted tapered shape. Therefore, the protruding terminal 53 can smoothly penetrate the portion between the mutually facing contact parts 153*c*.

Because the protruding terminal 53 in the example illustrated in FIG. 12(*a*) can also penetrate into either the top or bottom inside opening 154*a*, there is greater freedom in the relative positions of the male connector 1 and the female connector 101, and the fitting effort can be performed easily. In addition, because this forms what is known as a dual side support beam in which both the top and bottom sides of the contact parts 153*c* are supported by the arm parts 153*d*, there is a large biasing force that supports the contact parts 153*c*, and there is a large force by the pair of contact parts 153*c* that elastically sandwich the side surface part 53*c* of the protruding terminal 53 from both sides so that the contact between the side surface part 53*c* and the contact part 153*c* can be securely maintained.

In the example illustrated in FIG. 12(*b*), the receiving terminal 153 includes base parts 153*a* connected each in a pair to each of the left and right side edges of the terminal receiving openings 154 and separates the left side portion and the right side portion provided in a laterally symmetrical planar shape. Further, although each of the left side portion and right side portion provide arm parts 153*d* that are connected to each base part 153*a* above and below, and contact parts 153*c* that connect the tip end of the armed part 153*d* above and below, the planar shape is not provided vertically symmetrical.

Although the upper side base part 153*a*1 is positioned near the upper edge of the terminal receiving opening 154, the lower side base part 153*a*2 is positioned substantially in the middle of the top and bottom terminal receiving opening 154. Further, the contact part 153*c* resides in a position further to the bottom than the middle of the top and bottom terminal receiving openings 154. Additionally, although the planar shape of the upper side arm parts 153*d*1 is substantially a straight line or a significantly flattened shape of the letter V, the planar shape of the lower side arm parts 153*d*2 are a slightly bent shape of the letters J or U. In addition, the inside opening 154*a* is positioned between the left and right upper side arm parts 153*d*1.

When the shape of the inside opening 154*a* approaches the portion between the mutual contact parts 153*c*, the shape is such that the width dimension gradually decreases. In other words, the portion near the contact part 153*c* for the side end edge of the corresponding arm part 153*d* is provided with a slanted tapered shape. Therefore, the protruding terminal 53 can smoothly penetrate the portion between the mutually facing contact parts 153*c*.

Because the upper side of the inside opening 154*a* in the example illustrated in FIG. 12(*b*) is larger than the lower side, compared to the example illustrated in FIG. 12(*a*), the inside opening 154*a* can be larger so there is greater freedom in the relative positions of the male connector 1 and the female connector 101 and the fitting effort can be performed easily. Additionally, if the size of the inside opening 154*a* were to be the same as the example illustrated in FIG. 12(*a*), the overall size of the terminal receiving opening 154 can be made smaller thereby enabling an increase in the form density of the terminal receiving opening 154 and the receiving terminal 153. Also, because the length of the top and bottom arm parts 153*d* have a long so-called spring length, the range that the contact parts 153*c* can be elastically displaced is broadened and can accommodate a broad range of change in the width direction of the side surface part 53*c* of the protruding terminal 53 so that the contact between the side surface part 53*c* and the contact part 153*c* can be securely maintained.

In the examples illustrated in FIGS. 12(*c*)-(*d*), the receiving terminals 153 include base parts 153*a* connected each in a pair to each of the left and right side edges of the terminal receiving openings 154 and separates the left side portion and the right side portion provided in a laterally symmetrical planar shape. Further, although each of the left side portion and right side portion provide arm parts 153*d* that are connected to each base part 153*a* above and below, and contact parts 153*c* that connect the tip end of the armed part 153*d* above and below, the planar shape is not provided vertically symmetrical.

The upper side base part 153 a1 is positioned near the upper edge of the terminal receiving opening 154, and the lower side base part 153*a*2 is positioned near the lower edge of the terminal receiving opening 154. Further, the contact part 153*c* resides in a position further to the bottom than the middle of the top and bottom terminal receiving openings 154. Additionally, although the planar shape of the upper side arm parts 153*d*1 is substantially a straight line or a significantly flattened shape of the letter V, the planar shape of the lower side arm parts 153*d*2 are a slightly bent shape of the letters S or N. In addition, the inside opening 154*a* is positioned between the left and right upper side arm parts 153*d*1.

Because the length of the lower side arm parts 153*d*2 in the examples illustrated in FIGS. 12(*c*)-(*d*) are longer than the example illustrated in FIG. 12(*b*), the spring length is longer so that a broader range of displacement can be accommodated in the width dimension of the side surface part 53*c* of the protruding terminal 53. Other aspects are similar to the example given in FIG. 12(*b*), so the description thereof is omitted.

Next, referring to FIGS. 13-6, a description of the operation for fitting the male connector 1 with the female connector 101 will be given. Here, the female connector 101 is surface mounted on the board by the tail part 158 being connected by soldering or the like to a connection pad formed on the surface of the board. As illustrated, the female connector 101 is mounted in a disposition such that the back surface thereof faces the top surface of the board.

Figures 13A, 13B, 13C:
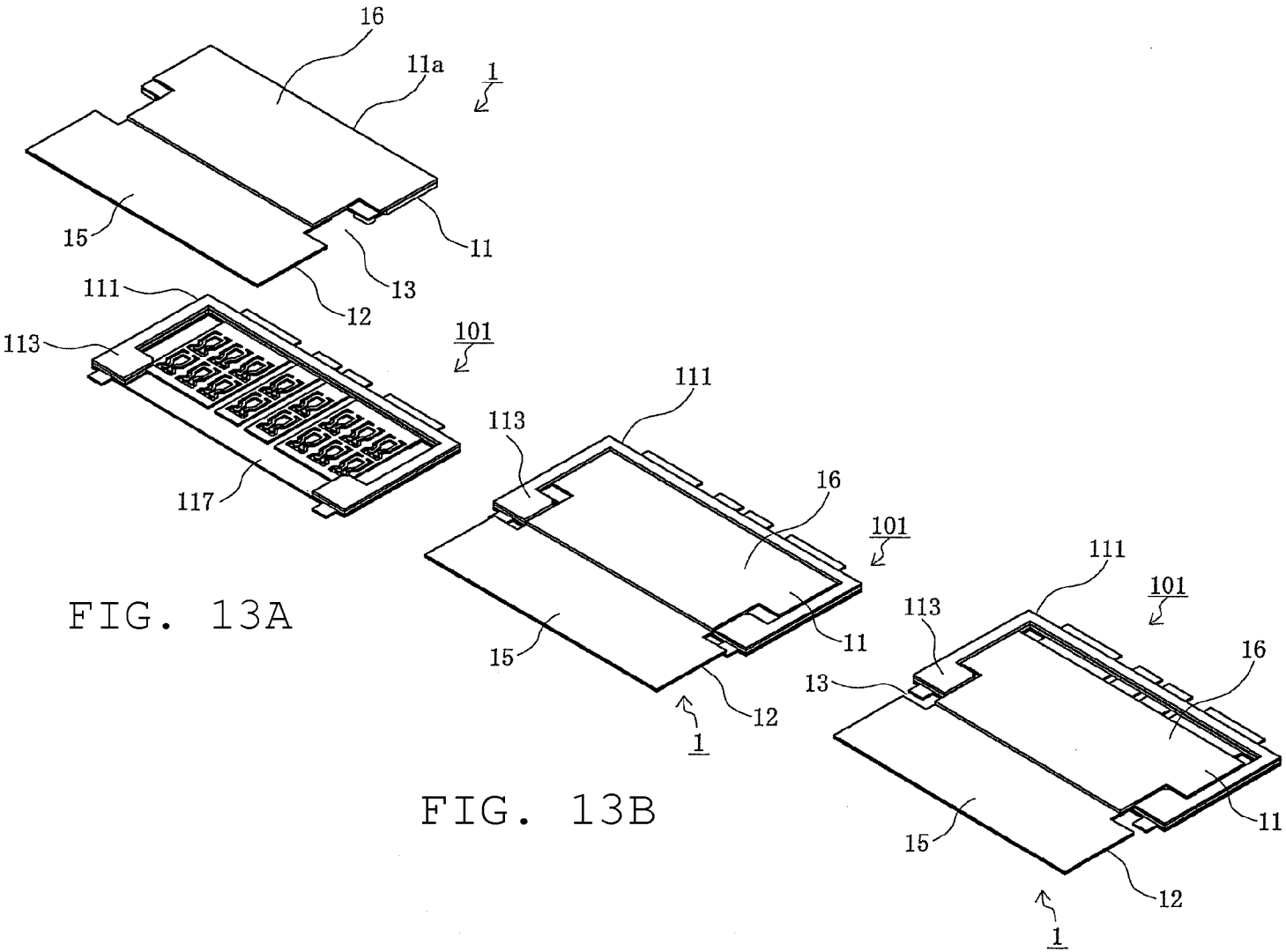
FIG. 13 is a view illustrating the fitting process for the male connector and the female connector, and (a) to (c) are views illustrating each step.
Figure 14:
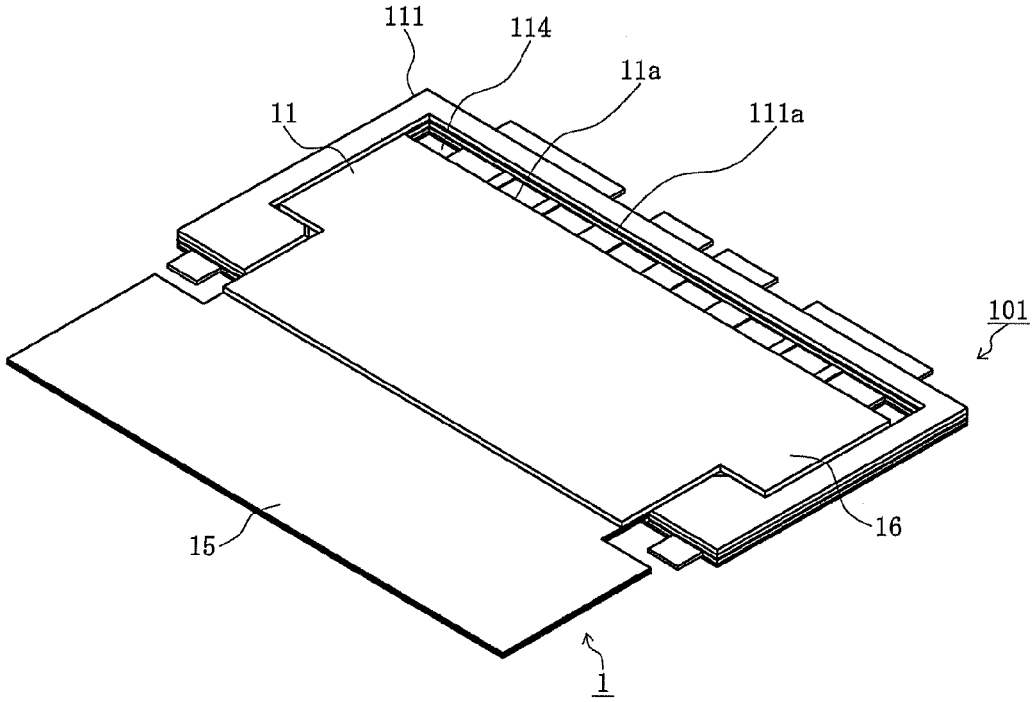
FIG. 14 is a perspective view illustrating a state in which the fitting process of FIG. 13 is complete.

First, the operator, as illustrated in FIG. 13(*a*), positions the disposition of the male connector 1 so that the surface where the protruding terminals 53 are formed faces the top surface of the female connector 101. In other words, the top surface of the male connector 1 faces the top surface of the female connector 101, and the male connector 1 is positioned above the female connector 101 such that the tip end part 11*a* of the connecting part 11 is in a disposition so as to match with the inside surface of the horizontal frame 111*a* of the frame 111.

Next, the operator relatively lowers the male connector 1 to the female connector 101, in other words moves in the fitting direction, to position the connecting part 11 within the connection recessed part 114 as illustrated in FIG. 13(*b*) so that the wide part 113 is positioned in the intermediate recessed part 13, and the top surface, which is the fitting surface, of the male connector 1 contacts with the top surface, which is the fitting surface, of the female connector 101. In this case, the tip end part 11*a* of the connecting part 11 contacts or is adjacent to the inner side of the horizontal frame 111*a* of the frame 111. By so doing, the connecting part 11 engages with the connecting recessed part 114, and the intermediate recessed part 13 engages with the wide part 113. Further, the left and right ear parts 21 of the connecting part 11 engage with the left and right ear receiving recessed parts 121 of the connecting recessed part 114, and the insertion raised part 56 positioned on the end of the ear part 21 penetrates into the insertion recessed part 156 that is a part of the ear receiving recessed part 121. In addition, each of the protruding terminals 53 penetrate into the inside opening 154*a* on the inner side of the corresponding receiving terminals 153. The tip end part 11*a* of the connecting part 11 separates from the inside surface of the horizontal frame 111*a* of the frame 111.

Next, the operator slides the male connector 1 in the relative locking direction in relation to the female connector 101. In other words, with the top surface of the male connector 1 in a contacted state with the top surface of the female connector 101, the male connector 1 is moved relatively rearward (bottom left direction in FIG. 13(*b*)) in relation to the female connector 101. In this case, each protruding terminal 53 penetrates into the inside opening 154*a* of the inside of corresponding receiving terminals 153, and is guided by sliding in a state in which the insertion recessed part 56 of the left and right ear parts 21 advances within the insertion recessed parts 156 of the left and right ear receiving recessed parts 121. Thus, the disposition of the male connector 1 in relation to the female connector 101 is not disrupted.

Further, as illustrated in FIGS. 13(*c*) and 14, when the fit between the male connector 1 in the female connector 101 is complete, the male fitting lock part 22 of the left and right ear parts 21 on the male connector 1 engages with the female fitting lock part 122 of the left and right wide parts 113 on the female connector 101. Specifically, the male side step part 23 of the male fitting lock part 22 generates a meshed state with the female side step part 123 of the female fitting lock part 122 so that the step part end surface 23*a* and a stepped surface 23*b* of the male side step part 23 faces the step part end surface 123*a* and the stepped surface 12*b* of the female side step part 123 so as to create a contacted or adjacent state. By so doing, the male connector 1 and the female connector 101 are locked together and the fitted state is maintained.

In addition, because the locking raised part 156*a* of the insertion recessed part 156 locks the locking recessed part 56*a* of the insertion raised part 56, the male connector 1 is prevented from sliding in a relative unlocking direction in relation to the female connector 101. Therefore, because the lock will not release by sliding the male connector 1 in a relative unlocking direction in relation to the female connector 101 even when receiving an external force or when receiving a vibration, the fitted state is maintained between the male connector 1 in the female connector 101. Further, because the release strength is significantly greater than the strength of the spring applied to the locking raised part 156*a*, the lock may be released between the locking raised part 156*a* and the locking recessed part 56*a* when the operator slides the male connector 1 in a relative unlocking direction in relation to the female connector 101, and thus the lock can be released.

Figure 16:
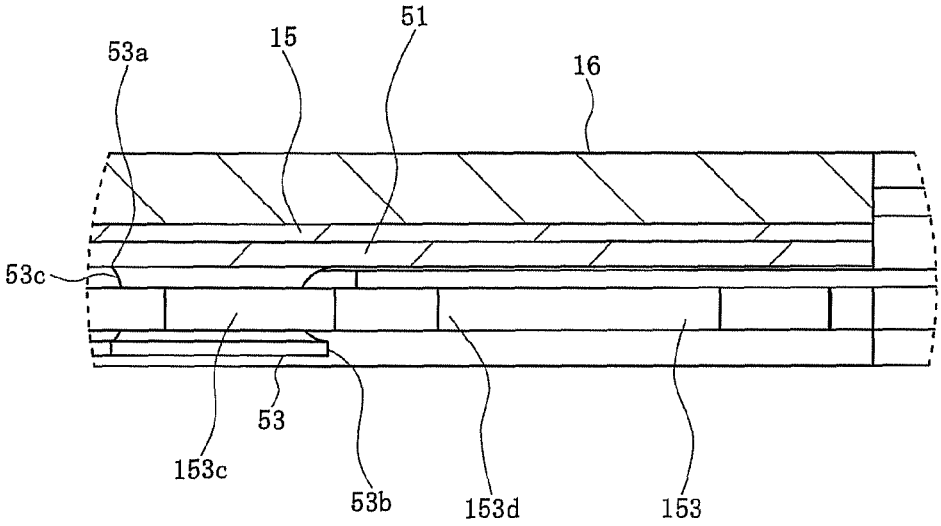
FIG. 16 is an essential part magnified view illustrating a state in which the fitting process of FIG. 13 is complete, and is a magnified view of the F portion in FIG. 15(*c*)

In addition, when the male connector 1 is slid in relative locking direction, in other words rearward, in relation to the female connector 101, the protruding terminal 53 penetrated within the inside opening 154*a* of the inside of the receiving terminal 153 is relatively moved within the inside opening 154*a* and, as illustrated in FIG. 16, penetrates between the mutually facing contact parts 153*c*. By so doing, because the gap between the mutual contact parts 153*c* contact the contact parts 53*c* of the protruding terminal 53 and are spread apart, a state is created in which the contact part 153*c* is pressed against the side surface part 53*c* of the protruding terminal 53 due to the bias of the arm part 153*d*. In other words, a pair of contact parts 153*c* elastically sandwiches the side surface part 53*c* of the protruding terminal 53 from both sides. In this manner, the sandwiching of the side surface part 53*c* of the protruding terminal 53 by the contact part 153*c* contributes to the maintenance of the fitted state.

Also, because the receiving terminal 153 is a thick member and the thickness dimension of the contacting part 153*c* is smaller than the height dimension of the protruding terminal 53, as illustrated in FIG. 16, the protruding terminals 53 securely penetrate the inside opening 154*a* of the corresponding receiving terminal 153, so that the side surface part 53*c* securely contacts the contacting part 153*c* even if dimensional errors (tolerance), shape strain and the like are generated for each part, causing positional slippage in the fitting direction of the male connector 1 and the female connector 101 between the protruding terminal 53 and the receiving terminal 153.

When the shape of the inside opening 154*a* approaches the portion between the mutual contact parts 153*c*, the shape is such that the width dimension gradually decreases. In addition, the shape of the horizontal cross-section of the protruding terminal 53 in the example illustrated in the Figures is a shape in which the rear portion is pointed. Therefore, when moving rearward to penetrate between the mutually facing contact parts 153*c*, smooth penetration enables the gap between the mutual contact parts 153*c* to be spread apart.

Further, because the receiving terminal 153 is a thick member, and the thickness dimension of the connecting part 153*c* is smaller than the height dimension of the protruding terminal 53 as illustrated in FIG. 16, the connecting part 153*c*, when receiving an external force or when receiving a vibration, may have the ability to move in the vertical direction of the protruding terminal 53 along the side surface part 53*c*.

However, because the side surface part 53*c* is a concave surface and includes the minimal point 53*d*, the position of the connecting part 153*c* that is elastically pressed to the side surface part 53*c* is always converged with the minimal point 53*d*, and because the elastic pressing force is greater when separating from the minimal point 53*d*, the connecting part 153*c* does not separate from the side surface part 53*c*. In other words, because the side surface part 53*c* is a concave surface, and because contact between the side surface part 53*c* and the connecting part 153*c* is securely maintained when receiving an external force or when receiving a vibration, an instantaneous interruption does not occur between the protruding terminal 53 and the receiving terminal 153.

The operation to remove the fit between the male connector 1 and the female connector 101 is nothing more than a reverse operation of the operation to fit the male connector 1 with the female connector 101, and therefore, a description thereof will be omitted.

In this manner, male connector 1 includes a flat plate shaped base film 15 and a plate-like conductive pattern 51 arranged on the surface of the base film 15, and also includes a flat plate shaped cable part 12 and a flat plate shaped connecting part 11 connected to the tip end of the cable part 12, and which engages with the female connector 101 as another connector. The connecting part 11 includes the protruding terminal 53 that engages with the receiving terminal 153 of the female connector 101. The protruding terminal 53 is a member integrally formed with the conductive pattern 51 so as to protrude from the surface of the conductive pattern 51 and includes the base end part 53*a* connected to the surface of the conductive pattern 51, and the tip end part 53*b* provided with a width dimension that is equal to or below the width dimension of the base end part 53*a*, and a side surface part 53*c* between the tip end part 53*b* and the base end part 53*a*; and the side surface part 53*c* is provided with a shape that recedes toward the inner side in the width direction more than the base end part 53*a* and the tip end part 53*b* and includes a minimal point 53*d* at which the width dimension is at a minimum.

By so doing, contact between the protruding terminal 53 and the receiving terminal 153 can be stably maintained and the occurrence of an instantaneous interruption can be securely prevented. In addition, because the width dimension of the tip end part 53*b* is suppressed to be equal to or below that of the base end part 53*a*, the protruding terminal 53 can easily penetrate into the inside opening 154*a* of the receiving terminal 153, and the work to fit the male connector 1 with the female connector 101 can be easily performed. Further, when removing the fit between the male connector 1 and the female connector 101, the receiving terminal 153 does not get hung up on the tip end part 53*b* and the tip end part 53*b* does not accidentally get wrenched. If the width dimension of the tip end part 53*b* were made to be even smaller (in other words, made to be smaller than the base end part 53*a*), then penetration into the inside opening 154*a* of the receiving terminal 153 of the protruding terminal 53 would be even easier.

In addition, the width dimension of the protruding terminal 53 is largest at the base end part 53*a* and gradually decreases going upward and is smallest at the minimal point 53*d*, then gradually increases going further upward to be equal to or less than that of the base end part 53*a* at the tip end part 53*b*. As the position of the receiving terminal 153 that contacts the side surface part 53*c* converges at the minimal point 53*d*, the contact state between the protruding terminal 53 and the receiving terminal 153 is stable. Thus, the generation of instantaneous interruption between the protruding terminal 53 and the receiving terminal 153 can be prevented.

In addition, when the protruding terminal 53 is engaged with the receiving terminal 153, the side surface part 53*c* is elastically sandwiched from both sides by the pair of contact parts 153*c* of the receiving terminal 153. By doing so, the contact between the side surface part 53*c* and the contact part 153*c* becomes stronger and can be securely maintained, even when receiving an outside force or vibration.

In addition, the dimension of the vertical direction of side surface part 53*c* is larger than the dimension of the vertical direction of the contact part 153*c* of the receiving terminal 153. By doing so, the contact between the side surface part 53*c* and the contact part 153*c* can be securely maintained even when there is a dimensional error, strain or the like in regard to the fitting connection between the male connector 1 and the female connector 101 (that is, the thickness direction of the male connector 1 and the female connector 101).

In addition, the horizontal cross-section of the protruding terminal 53 has a dimension in which the front and rear direction is larger than the dimension of the width direction, and the rear direction has a pointed shape. By doing so, protruding terminal 53 can smoothly penetrate the space between mutual contact parts 153*c*.

Figure 17B:
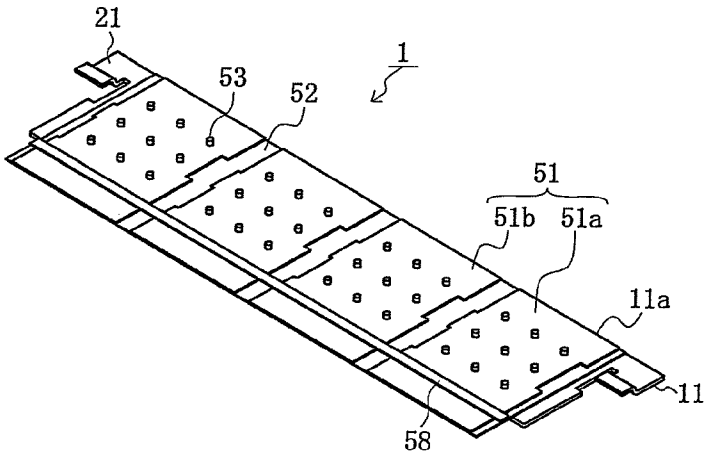
FIG. 17 is a view illustrating the male connector according to an embodiment of the Present Disclosure, where (a) is a top surface view, (b) is a perspective view as seen from the top surface side.
Figure 17A:
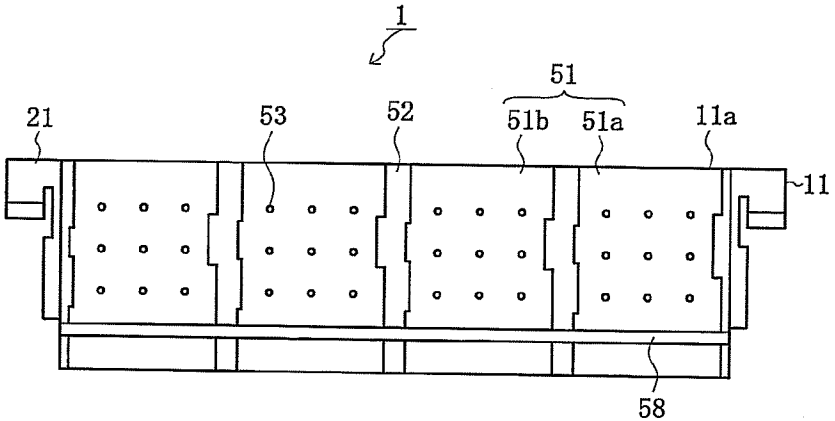
Figure 18:
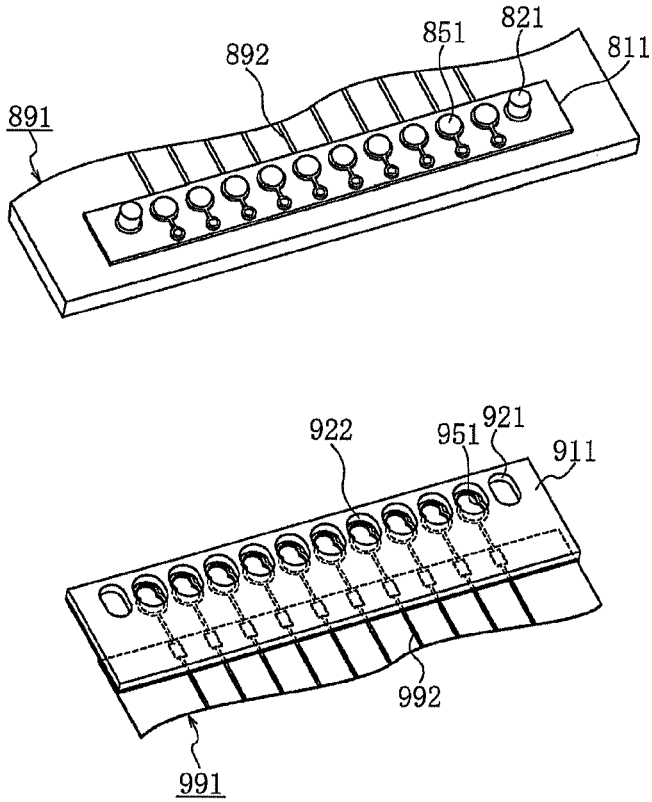
Prior art FIG. 18
FIG. 18 is a perspective view of a conventional sheet connector.

FIG. 17 illustrates a further embodiment of the Present Disclosure. This description will omit the explanation for those items with the same structure as the previous embodiment but will give the same reference number. Further, regarding the same operation and effects as the first embodiment, such description will be also omitted.

In the conductive pattern 51 of the male connector 1, as illustrated in FIG. 17, the width of the wide pattern 51*a* is substantially equivalent to the width of the narrow pattern 51*b*, but the size relationship of the widths of the wide pattern 51*a* and the narrow pattern 51*b* are not limited to this and can be modified appropriately. Also, only the connecting part 11 is illustrated in the Figure while the illustration of the cable part 12 is omitted for convenience in the description. Incidentally, the cable part 12 is connected to the rear and side of the connecting part 11 (bottom end side in FIG. 17(*a*)); in other words, the opposite side of the tip end part 11*a*.

Further, the protruding terminal 53 in the example illustrated in FIG. 17 is arrayed in a lattice shape to form three rows that extend in the width direction. In addition, three protruding terminals 53 are included in each row in both the wide pattern 51*a* and the narrow pattern 51*b*, and the protruding terminals 53 in each of the rows are arranged in a direct line that extends in the front and rear direction of the male connector 1. In other words, it is arranged so that forms a rectangular planar lattice in which the axes that extend in the front and rear direction and the left and right direction of the male connector 1 form a lattice line. In addition, a solder barrier 58, as a solder barrier line made of a material to which solder is difficult to adhere, is formed to a side further back than the protruding terminal 53 (bottom side in FIG. 17(*a*)) on the top surface of the connecting part 11 (that is, the side to which the cable part 12 not illustrated is connected).

The solder barrier 58 crosses the entire range of the width direction of the connecting part 11, and is provided in a thin strip or a line shape that extends in the width direction of the connecting part 11, and typically, is formed on the top surface of the connecting part 11 by applying a hydrophobic coating that provides water resistance. The hydrophobic coating is preferably formed by applying on the top surface of the connecting part 11 without spraying. By doing so, the hydrophobic coating can be prevented from scattering around the periphery.

The solder barrier 58 in the example illustrated in FIG. 17 is also formed on the top surface of the pattern separation space 52, but it may be formed only on the top surface of the conductive pattern 51. In addition, the solder barrier 58 may be formed in other locations as necessary, for example, further to the front side than the protruding terminal 53 on the top surface of the connecting part 11, or the solder barrier 58 can be at least partially formed around the protruding element 53 on the top surface of the connecting part 11.

Further, other points of configuration with the male connector 1 and the female connector 101 are the same as the previous embodiment, and therefore descriptions thereof are omitted.

Thus, a solder barrier 58 is formed at least partially around the periphery of the protruding terminal 53 on the surface of the connecting part 11. Typically, the solder barrier 58 is provided more to the rear side than the protruding terminal 53. Therefore, solder is not accidentally applied to the protruding terminals 53 because the solder rise phenomenon can be securely prevented even when connecting the cable part 12 to the rear end side of the connecting part 11 by soldering and even when mounting the male connector 1 and/or the female connector 101 by soldering to the surface of a printed circuit board not shown or the surface of the board such as a flexible circuit board.

While a preferred embodiment of the Present Disclosure is shown and described, it is envisioned that those skilled in the art may devise various modifications without departing from the spirit and scope of the foregoing Description and the appended Claims.

What is claimed is:

1. A sheet connector, comprising:

a substrate part the substrate part including:

a conductive pattern arranged thereon;

a cable part; and a connecting part connected to a tip end of the cable part, and which fits into a second connector, the connecting part including a protruding terminal engaging another terminal of the second connector;

wherein:

the protruding terminal is integrally formed with the conductive pattern to protrude from the surface of the conductive pattern, and includes a base end part connected to the surface of the conductive pattern, an upper end part provided with a width dimension equal to or less than the width dimension of the base end part, and a side surface part disposed between the upper end part and the base end part; and the side surface part is provided with a shape that recedes toward an inner side in the width direction more than the base end part and the upper end part, and includes a minimal point at which the width dimension is at a minimum.

2. The sheet connector according to claim 1, wherein the width dimension of the protruding terminal is largest at the base end part, gradually decreases going upward, is smallest at the minimal point, then gradually increases going further upward to be equal to or less than the size of the base end part at the top end part.

3. The sheet connector according to claim 2, wherein, as the protruding terminal engages the second terminal, the side surface part is elastically sandwiched from both sides by a pair of connecting parts of the second terminal.

4. The sheet connector according to claim 3, wherein the dimension in the vertical direction of the side surface part is larger than the dimension in the vertical direction of the connecting part of the second terminal.

5. The sheet connector according to claim 4, wherein a horizontal cross-section of the protruding terminal has a length in which the front and rear direction is longer than a length in a width direction, and the rear direction has a pointed shape.

6. The sheet connector according to claim 5, wherein the protruding terminal is provided in a plurality and is arrayed in a lattice shape on the surface of the conductive pattern on the connecting part.

7. The sheet connector according to claim 6, wherein a solder barrier is formed at least partially around the periphery of the protruding terminal on the surface of the connecting part.

8. The sheet connector according to claim 7, wherein the solder barrier is formed in a strip shape to extend in the width direction of the connecting part.

9. The sheet connector according to claim 8, wherein the solder barrier is made of a hydrophobic coating.

* * * * *